US007182344B2

(12) United States Patent
Bloom

(10) Patent No.: US 7,182,344 B2
(45) Date of Patent: Feb. 27, 2007

(54) WORD GAME

(76) Inventor: Stephen Bloom, 13 Old Orchard Rd., Rye Brook, NY (US) 10573

( * ) Notice: Subject to any disclaimer, the term of this patent is extended or adjusted under 35 U.S.C. 154(b) by 0 days.

(21) Appl. No.: 10/923,269

(22) Filed: Aug. 20, 2004

(65) Prior Publication Data

US 2005/0179205 A1 Aug. 18, 2005

Related U.S. Application Data

(60) Provisional application No. 60/497,406, filed on Aug. 22, 2003.

(51) Int. Cl.
*A63F 1/00* (2006.01)

(52) U.S. Cl. ..... 273/299; 273/292; 273/302

(58) Field of Classification Search ..... 273/292, 273/299, 302–308, 272
See application file for complete search history.

(56) References Cited

OTHER PUBLICATIONS

"How To Play Casino Poker—Texas Hold'em" by Victor Royer, http://www.vegas.com/vegascom/betbasc/holdem, received in the PTO Jul. 11, 1996.*

Letterhead Rulebook by Kristan Lawson and Herbert R. Lawson, "Stormy Letters", "Word Porker", "Seven-Letter Stud", Atlas Games, htp://www.atlas-games.com, copyright 2000.*

* cited by examiner

*Primary Examiner*—Benjamin H. Layno
(74) *Attorney, Agent, or Firm*—Darby & Darby

(57) ABSTRACT

A word game based on "hold'em poker is played using one or more decks of cards, with each card containing a consonant or a vowel. In the preferred embodiment, separate decks are provided for the vowels and consonants, respectively. Two cards from the vowel deck are dealt face down to each player. Three consonant cards are then dealt face up in the center of the table. These face up consonant cards are available for use by all players. The object of the game is to provide the longest word possible using the face down cards and the face up cards in the center of the table. After the three up cards have been dealt, the players bet using play money distributed to the players at the beginning of the game. After the first round of betting is complete, a fourth consonant card is dealt face up in the center of the table and a further round of betting takes place. A fifth card (also a consonant card) is dealt face up in the center of the table and the final round of betting takes place.

3 Claims, 1 Drawing Sheet

WORD GAME

This application claims priority to U.S. Ser. No. 60/497,406, filed on Aug. 22, 2003. This prior application is incorporated herein by reference.

FIELD OF THE INVENTION

This invention relates to a word game which is played with cards. More particularly, this invention relates to a word game which is based on "hold'em" poker, a well-known card game.

BACKGROUND OF THE INVENTION

There are many different versions of poker. One particularly popular version is known as "hold'em" poker in which each player is dealt two cards "down" (i.e. hidden from the view of the remaining players). Three cards are then dealt "up" (i.e. visible to all of the players). Each player considers the value of his hand based on the cards that were dealt to him "down" (also known as "hole" cards) and the three common "up" cards. The players then place the first bet in a prescribed fashion, with the players having the options to "fold" (drop out of the hand), "see" (match) the bet, or "raise" (increase) the bet.

After the first round of betting is complete, two more cards are dealt face up for all of the players to use. After each of the cards is dealt, a further round of betting takes place. The winner is the player remaining in the game with the best poker hand.

"Hold'em" poker and variations thereof have achieved great popularity in the United States. The game is not only played in casinos, it is readily available on the internet and is the subject of numerous well-attended tournaments. Major tournaments typically are telecast nationally.

The object of this invention is to provide a word game which is based on "hold'em" poker.

SUMMARY OF THE INVENTION

In accordance with the invention, one or more decks of cards are used, with each card containing a consonant or a vowel on one side. In the preferred embodiment, separate decks are provided for the vowels and consonants, respectively. Two cards, preferably from the vowel deck, are dealt face down to each player. Three cards, preferably consonant cards, are then dealt face up in the center of the table. These face up consonant cards are available for use by all players. The object of the game may be to provide the longest word possible using the player's face down cards (the hole cards) and the common face up cards in the center of the table. After the three up cards have been dealt, the players bet, preferably using play money distributed to the players at the beginning of the game. After the first round of betting is complete, a fourth card (preferably a consonant card) is dealt face up in the center of the table and a further round of betting takes place. Thereafter, the fifth card (also preferably a consonant card) is dealt face up in the center of the table and the final round of betting takes place.

The player who forms the longest word using his or her hole cards and the up cards in the center of the table wins the "pot," i.e. all of the money that was wagered by the players at the table.

DETAILED DESCRIPTION

The game is a betting game and can be played with real money or play money. If play money is used, it is distributed to the players at the beginning of the game. By way of example only, each player in the game may start with $1,000, consisting of ten $25 bills, five $50 bills, and five $100 bills. Obviously, other denominations can be used.

Figure 1:
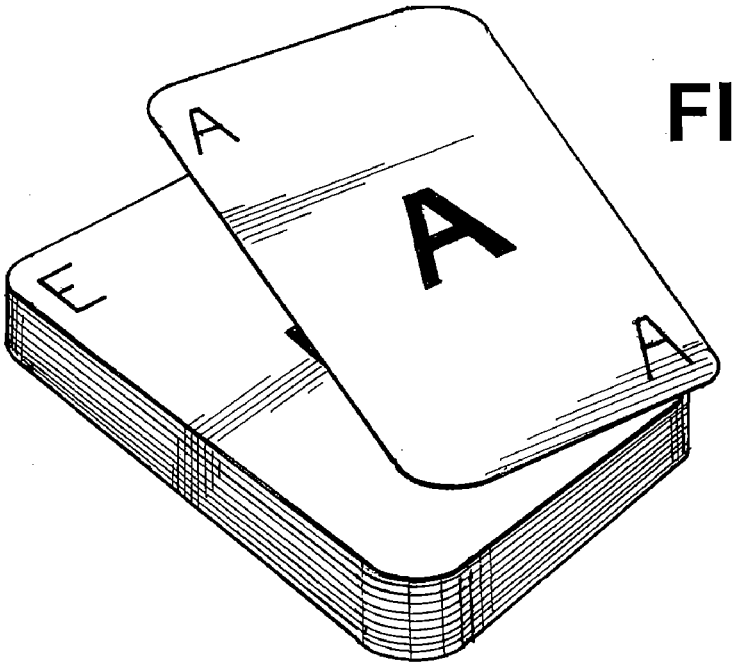
FIG. 1 is a perspective view of a deck of cards containing only vowels in accordance with a preferred embodiment of the invention.
Figure 2:
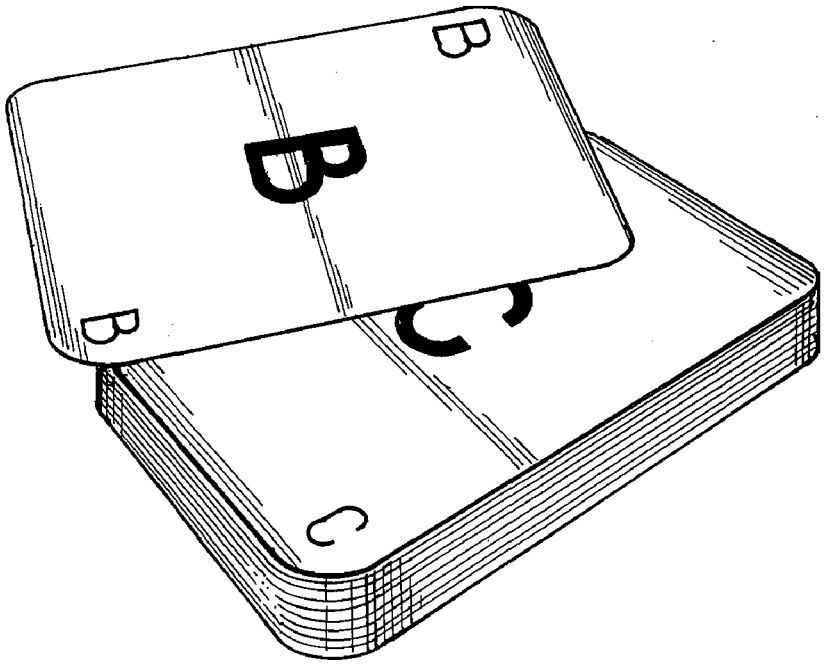
FIG. 2 is a perspective view of a deck of cards containing only consonants in accordance with a preferred embodiment of the invention.

In the preferred embodiment of the invention, two separate decks are used. One deck (FIG. 1), contains only vowels (a, e, i, o, and u) and the other deck (FIG. 2), contains only consonants. Any number of players can play the game, but assuming that a maximum of seven players are to play at one time, the vowel deck may contain at least three of each vowel for a total of at least fifteen cards. The consonant deck may contain two of each consonant for a total of forty-two cards. Obviously, other arrangements can be used. For example, particularly in the case of the consonants, the distribution of the individual letters may be generally proportional to the normal usage of the letter as in Scrabble®. For example, the consonant deck would contain more b's and c's than x's and z's.

In the preferred embodiment, the object of each hand is to form the longest word using the letters on the cards that are dealt. As in "hold'em" poker, the player can use his or her "hole" cards and the common cards in the center.

The game may be played as follows:

1. each player antes $25;

2. two vowel cards from the vowel deck are dealt to each player face down. These are the player's "hole" cards;

3. using the deck of consonant cards, three consonant cards are dealt face up in the center of the table. These face up consonant cards are available for use by all players. The players may "pass" (not bet) or bet up to $50 (for example). As in poker, a player may "see" (match) the bet, "fold" (drop out of the hand), or "raise" (increase the bet);

4. after the first round of betting is complete, another consonant card is dealt face up for all of the players to use. A further round of betting takes place with a limit up to $100. The players can pass, bet, raise or fold as in standard poker;

5. a fifth and last consonant card is dealt face up for all of the players to use. In this round the players may bet up to $250. This is the final round of betting.

The players are also provided with a pad of paper and pencil. After the final round, each player writes down the longest word that he or she can compose using the five "up" cards in the center and the two vowel cards in the "hole." The player with the longest word wins the "pot" (the money wagered on the hand). If two or more players use the same number of letters to form a word, there is a tie and they share the pot. A predetermined number of "hands" may comprise a complete game; for example, ten hands may comprise a complete game. The winner of the game is the player who has accumulated the most dollars.

It is not necessary to declare a winner after a predetermined number of hands, and a game can simply continue until a player has accumulated a predetermined amount of money or for an agreed upon length of time.

Instead of determining a winner based on the longest word formed, other criteria may be employed. For example, different letters may be assigned different numerical values with the winner being determined by calculating the total numerical value of the letters used to form a word. In such a case, the longest word might not necessarily have the highest numerical value.

As a variation, each of the players may be dealt three vowel cards face down instead of two. In this case the size of the deck may be increased to accommodate all of the players. For example, with seven players, the vowel deck must include at least twenty-one cards instead of the fourteen required when only two vowel cards are dealt.

What is claimed is:

1. A method of playing a word game comprising:

providing at least two separate decks of cards, the cards of one deck containing only vowels and the cards of the other deck containing only consonants;

dealing only from the deck of vowel cards two vowel cards face down to each player in the game;

dealing only from the deck of consonant cards three consonant cards face up so that the letters on the card are visible to all of the players;

allowing the players to place wagers;

dealing at least two additional consonant cards face up so that they are visible to all of the players;

allowing the players to place additional wagers after each of said additional cards is dealt; and determining the winner of the wager based on the words formed by the individual players using their face down cards in combination with the face up cards.

2. A word game according to claim 1, wherein, during each round of wagering, one player makes an initial bet and the remaining players have the option of matching the bet, dropping out of the hand, or raising the bet.

3. A word game according to claim 2, wherein the player who forms the longest word is the winner of the wager.

* * * * *